US006747251B1

(12) United States Patent
Belanger

(10) Patent No.: US 6,747,251 B1
(45) Date of Patent: Jun. 8, 2004

(54) FAST RESPONSE HEATER FOR A GLUE GUN

(75) Inventor: Richard A. Belanger, Kensington, NH (US)

(73) Assignee: Adhesive Technologies, Inc., Hampton, NH (US)

( * ) Notice: Subject to any disclaimer, the term of this patent is extended or adjusted under 35 U.S.C. 154(b) by 0 days.

(21) Appl. No.: 09/806,575

(22) PCT Filed: Dec. 9, 1999

(86) PCT No.: PCT/US99/27923

§ 371 (c)(1),
(2), (4) Date: Apr. 2, 2001

(87) PCT Pub. No.: WO00/34179

PCT Pub. Date: Jun. 15, 2000

Related U.S. Application Data

(60) Provisional application No. 60/111,545, filed on Dec. 9, 1998.

(51) Int. Cl.[7] ..... B67D 5/62; H05B 3/58

(52) U.S. Cl. ..... 219/424; 219/530; 219/534; 219/535; 222/146.5

(58) Field of Search ..... 219/421–426, 219/521, 530, 534, 535; 222/146.5; 401/1, 2; 392/313

(56) References Cited

U.S. PATENT DOCUMENTS

| | | | | | |
|---|---|---|---|---|---|
| 3,612,357 | A | * | 10/1971 | Ruskins | 222/146.5 |
| 3,665,158 | A | * | 5/1972 | Froedge | 219/421 |
| 3,744,921 | A | * | 7/1973 | Weller et al. | 222/146.5 |
| 4,032,046 | A | * | 6/1977 | Elliott et al. | 219/421 |
| 4,059,204 | A | * | 11/1977 | Duncan et al. | 222/146.5 |
| 4,065,034 | A | * | 12/1977 | Callan | 222/146.5 |
| 4,253,011 | A | * | 2/1981 | Hinz | 219/421 |
| 4,524,887 | A | * | 6/1985 | Cocks | 222/146.5 |
| 4,926,029 | A | * | 5/1990 | Pearson | 219/214 |
| 5,462,206 | A | * | 10/1995 | Kwasie | 222/146.5 |

* cited by examiner

*Primary Examiner*—Joseph Pelham
(74) *Attorney, Agent, or Firm*—Clark & Brody

(57) ABSTRACT

A heating system for a hand-held glue gun has a low-mass melting chamber, high-power resistance heating element, and thermostat (24). The heating element is arranged between the chamber and thermostat (24), so that the thermostat's (24) response to the heating element mirrors that of the load in the chamber.

15 Claims, 1 Drawing Sheet

FAST RESPONSE HEATER FOR A GLUE GUN

CROSS REFERENCE TO RELATED APPLICATION

This application is a §371 of PCT/US99/27923 filed on Dec. 9, 1999, which was published in English as WO/00/34179 and claims the benefit of U.S. Provisional Application No. 60/111,545 filed on Dec. 9, 1998.

TECHNICAL FIELD

This invention relates to the art of electric heating systems. In preferred embodiments, the invention relates to an improved electric heating element for a hand-held, hot-melt glue gun.

BACKGROUND ART

Hand-held, hot-melt glue guns are provided with a chamber for heating and melting a solid, hot-melt material, which is typically in the form of a cylindrical stick. The material may be in any of several other shapes, including sticks having other cross sections, slugs, or chips. After melting, the composition is applied to a variety of surfaces.

The melting chamber is usually made of aluminum and has a cylindrical cavity for receiving the glue stick. The glue stick melts as it comes into thermal contact with the interior walls of the chamber, the heat being transferred primarily by conduction. A cartridge heater, a PTC (positive temperature coefficient) pellet, a rope heater or a resistance wire heater is typically provided to heat the chamber, and temperature control to prevent overheating is typically provided by a thermostat. One problem with the known temperature control, however, is that of overshoot, which arises from the fact that the chamber has thermal mass. Because of thermal inertia, the temperature of parts of the chamber, particularly those remote from the thermostat, will continue to increase even after the thermostat has terminated flow of electricity to the heater. The magnitude of the thermal inertia is a function of several factors, and the mass of the heating system is a primary factor.

Glue guns that are less expensive utilize PTC heaters because that type of heater is cost effective. One drawback is that PTC heating elements are of limited power, which can require the use of more than one element with consequent increase in cost. More power can be obtained by using a resistance heater with a discrete thermostat for temperature control, but the increased cost allows this in only more expensive systems. Further, the heat-up and melting performance of the known resistance heater systems is only marginally better than that of the PTC systems.

In prior systems, the chamber must be large enough to accommodate the heater cartridge and the thermostat. Thus, the prior systems have significant physical mass, resulting in significant thermal mass and thermal inertia. This mass results in a long warm-up time, for example, of 3–5 minutes, and increased overshooting. The problems created by this overshooting often outweigh the benefits obtained by the use of a PTC heater in the first place.

The usual heater is also provided with a silicone sleeve at the entrance to the heating chamber to provide a transition zone for the glue stick. The heating element must also heat the sleeve, by contact with the heating chamber, so that the glue stick will be able to "breakaway" and enter the heating chamber. The required heating of the sleeve increases the warm-up time considerably.

Thus, there is a need for a heater that is capable of heating quickly, e.g., within 30 seconds, and effectively controlling temperature to significantly improve the convenience of glue guns.

SUMMARY OF THE INVENTION

In accordance with the invention, a heating chamber for a glue gun is capable of attaining an operating temperature in about 30 seconds. Further, the new heating chamber can be manufactured less expensively than conventional heaters and has a wider range of applications.

In a preferred embodiment of the invention, the heating chamber comprises a cylindrical tube that supports a coil of electrical heating wire. The cylindrical tube is preferably made of metal, such as aluminum, and provides a hollow core forming a cavity for receiving the glue to be melted. The tube may be of other materials, such as ceramic, high-temperature plastic, carbon-filled plastic, and the like. The core tapers slightly longitudinally (e.g., 2°) to provide draft and facilitate manufacture and may be die-cast or made by a screw machine. An important aspect of the inventive construction is that the thickness of the wall between the core and the exterior is preferably no greater than about 0.06 inches to reduce the mass of the heater markedly. The preferred chamber weighs approximately 17 grams, compared with about 45 grams for prior-art chambers of similar capabilities and having similar functions. One end of the chamber is designed to receive the glue stick, while the other is designed to receive a discharge nozzle. The nozzle may be an integral part of the chamber, but in the preferred embodiment the end of the chamber is internally or externally threaded for receiving a separate, threaded nozzle with a check valve to control dripping.

The outer surface of the tube is covered with a thermally conductive and electrically insulating film, such as a processed mica film. Other films may be used, such as a polyimide film sold under the trademark Kapton, a thin wall silicone film, a ceramic element or coating, a hardcoat anodized coating, and the like. As well, epoxy paint can be used as an electrical insulator. In the preferred embodiment, the tube is wrapped tightly with the film to ensure thermal contact, and the film is then secured to the tube by longitudinally spaced coils of 0.020 inch stainless steel lockwire. Then, a resistance heating wire, preferably made of 80% nickel and 20% chromium and sold under the trademark Nichrome, is wrapped over the electrically insulating film to form a tight coil extending longitudinally along the cylindrical tube. The individual coils are preferably spaced evenly along the major part of the tube, but it may be desired to vary the spacing to provide different rates of heating along the chamber. For example, it may be desired to provide more heat to the output end of the chamber. The size and length of the heating wire will vary depending on the specific application, including the heat to be generated and the physical dimensions of the tube.

While resistance wire is used in the preferred embodiment, it will be appreciated that other high power heating elements can be employed, such as a deposited carbon film, a woven resistance film, a Nichrome wire in a metal sheath, and the like.

The wire in the embodiment shown may be wound onto the tube in a variety of ways, such as by machine winding on a fixture resembling a lathe. Each end of the heating wire is secured to the tube, as by a lockwire also. Insulated lead wires are then attached to the ends of the heating wire, as by crimping. The coil of heating wire is then covered with a second layer of electrically insulating film, preferably the processed mica film, and secured as with lockwire in a manner similar to that of the first film.

Temperature control is provided by controlling power to the heating wire with a thermostat. This thermostat is physically attached to the insulated surface by a mechanical fastener, such as lockwire, and electrically connected in series with the heating coil to provide basic temperature control. By this arrangement, the thermostat picks up heat from the heating coil directly, which indicates the temperature of the chamber more quickly than do prior sensors that measure the temperature of the casting directly by being embedded in the casting. This construction reduces the time necessary to respond to the heat cycle to a few seconds.

Applicant has found that this arrangement greatly reduces overshoot problems and increases the ability of the thermostat to respond to the heating requirements. For example, cold glue presents a substantial thermal load that will absorb much of the heat provided by the coil. In this case, absorption of heat from the coil will keep it cooler, and the thermostat will heat more slowly. As the glue heats, it will absorb less heat from the coil, and the temperature of the coil will increase. Thus, as the glue heats up the thermostat will heat more quickly. In either instance, the rate at which the heating coil heats the thermostat is more closely tied to the rate at which it heats the load than in systems where the thermostat is located in the metal casting.

A basic concept of the invention is to provide a low mass, high power, fast-heating chamber controlled by a thermostat that measures the temperature of the load indirectly by reacting to the temperature of the heating element without significant overshoot. The thermal characteristics of the thermostat are designed such that the temperature difference between the heating coil and the melted glue is the same, or essentially the same, as the temperature difference between the heating coil and the thermostatic element held in the thermostat's casing, when the glue is at the desired temperature. Thus, the mass of the thermostatic element and its casing, and the casing's area of contact with the coil should be such that the thermostat reacts to the heating coil in a manner similar to that of the cylinder and the heated glue. This is particularly useful in the environment of the present invention because the heating coil is of such high power compared to the mass of the cylindrical tube that any lag in detecting the temperature of the tube can result in melting the tube.

Other types of temperature control can be used. For example, a thermistor placed in a metal casing and designed to absorb heat as set forth above could be used. In this example, a negative temperature coefficient (NTC) thermistor, whose resistance decreases with increasing temperature, senses the temperature of the system, and a solid state comparator circuit switches a relay or Triac on or off to control the heating element.

Applicant has determined that a preferred circuit for providing power to the resistance-heating element includes a ½ wave rectifier to reduce the voltage and resultant power delivered to the heater. This is preferred because it has been found more difficult to size the heating wire for glue guns that operate on 120 VAC or higher voltage. Use of a rectifier circuit, allows the heater wire to be of heavier gauge and, therefore, more durable and easy to handle, even in small wattage ranges. One reason the heavier wire is more durable is that it is subjected to less thermal stress.

In a preferred embodiment, 33 Ohms of #30 Gauge wire (about 6.4 Ohms per foot) was used to deliver about 190 Watts of power to a cylindrical tube weighing 17 grams. This arrangement provided 10–11 Watts per gram. A conventional arrangement provides about 40 Watts for a heater weighing about 45 grams, or a ratio of about 1 watt per gram. Thus, a system in accordance with the invention heats about ten times faster than the conventional system.

The preferred embodiment described has been found to heat to operating temperature consistently in less than 30 seconds and to provide larger continuous melting than conventional systems. Thus, warm up time has been reduced from 3 minutes to 30 seconds. Further, the melt rate was not compromised because the system is more responsive to temperature drops during normal usage.

DETAILED DESCRIPTION OF THE PREFERRED EMBODIMENT

Figure 1:
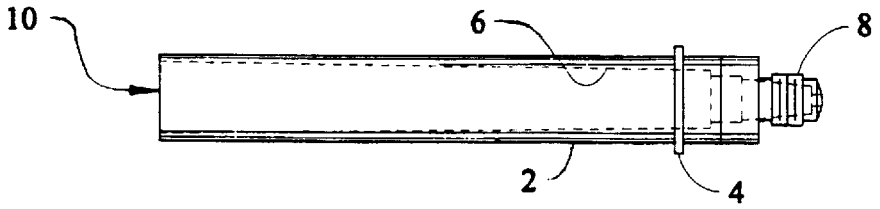
FIG. 1 is a side view of a heating chamber in accordance with the invention.

With reference to FIG. 1, a preferred embodiment of a heating chamber in accordance with the invention includes a cylindrical tube 2, which is die cast of aluminum and includes a flange 4 for engaging a glue gun housing (not illustrated). The tube includes a hollow core 6 with a slight draft for facilitating manufacture. The hollow core connects with an externally threaded body, which is shown as a male part 8 in FIG. 1, for engaging an outlet nozzle cap. The opposite end of the tube provides an inlet opening 10 for the glue stick.

Figure 2:
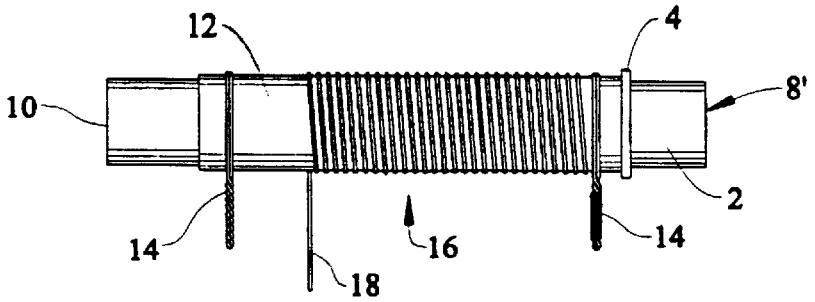
FIG. 2 is a side view of a heating system in accordance with the invention during assembly with a second embodiment of a heating chamber.

FIG. 2 illustrates the heating system during construction with a second embodiment of the cylindrical tube 2. In this embodiment one end is provided with an internally threaded female opening 8' for receiving an outlet nozzle, shown in FIG. 3. As shown in FIG. 2, the tube 2 has been wrapped with a thermally conductive, electrically insulating film 12 of processed mica. The film 12 is secured to the tube by stainless steel wire locks 14. Then, the cylinder and film 12 are wrapped with a coil 16 of Nichrome wire 18. The coil preferably extends the entire length of the cylinder, but the actual length and spacing of the coils will be determined by the heating requirements placed on the chamber. In some instances it may be desirable to vary the spacing such that there are more coils at the inlet end to provide more heat to the glue stick just as it enters the chamber.

Figure 3:
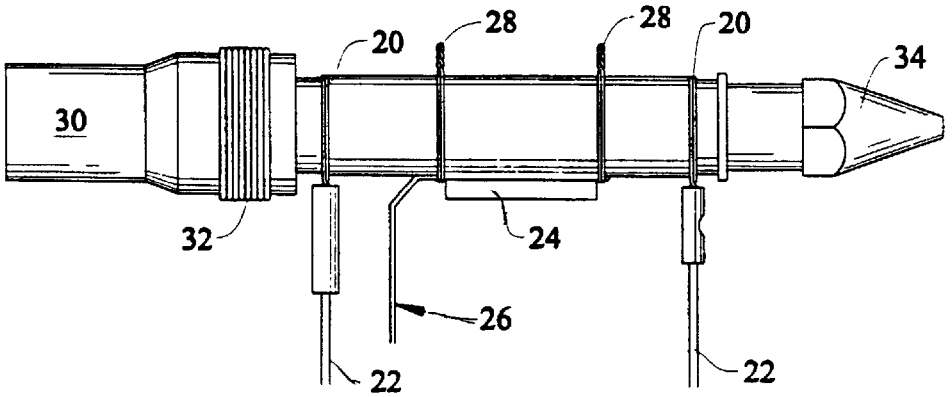
FIG. 3 is a side view of a completed heating system in accordance with the invention.

FIG. 3 illustrates a complete heating system. Thus, the coil 16 has been wound completely along the cylinder, and a second electrically insulating, thermally conductive film of processed mica has been placed over the coil. The ends of the heating wire 18 and the second film have been secured to the cylinder by wire locks 20, and a respective electrical lead 22 has been attached to each end. The leads are swaged to the heating wire by known means.

A thermostat 24 having electrical leads 26 is held onto the outside of the coil, preferably via stainless steel wire locks 28, with the insulating film between the thermostat and the coil. The preferred thermostat is a creep-type thermostat mounted in a stainless steel case. The thermostat case is, thus, placed in direct thermal contact with the heating wire in a substantially symmetrical fashion. This provides the noted improvement because the thermostat is subjected to the same heating as the cylindrical tube.

A silicone inlet sleeve 30 is secured to one end of the tube to communicate with the opening 10. The sleeve is held to the tube by a spring coil 32, as known in the art. The sleeve provides a transition for entry of the glue stick into the hollow cavity 6 of the heating chamber. A nozzle cap 34 is threaded into the opening in the cylindrical tube.

Figure 4:
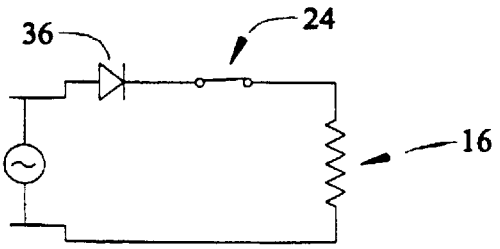
FIG. 4 is a circuit diagram of a preferred control circuit.

FIG. 4 illustrates a preferred circuit for providing power to the heating wire 18. This circuit includes a series arrangement of the thermostat, the coil 16, and a diode 36 for reducing the power applied to the wire. In the preferred embodiment wherein the heater is to be used on a hand held glue gun, the circuit is connected to a source of 120 volt AC power.

The described construction has a wide range of applicability and may be applied to virtually all known glue gun designs. Each gun, of course, requires application of individual parameters, but the design of the invention provides the necessary flexibility for accommodating various combinations of power and mass. It is further envisioned that the Nichrome wire could be replaced by insulated wire, which would eliminate the need for one or more layers of insulating material and the need for accurate winding of the coil. Also, the thermostat may be replaced with a solid-state comparator circuit or similar temperature control, particularly for glue guns operating with DC power.

The inventive arrangement has been found to provide a unique ability to accommodate the various elements of a heater, including the specific heat of the material to be melted, the mass of the chamber and its mass/wattage ratio, the physical properties of the wire and thermostats, and the electrical components. This design is not limited to hand-held, hot-melt glue guns, and the invention may find utility in industrial glue guns and other heating environments as well. Modifications within the scope of the appended claims will be apparent to those of skill in the art.

I claim:

1. A heating system comprising a melting chamber having low thermal inertia, a heating element having one side in thermal contact with said chamber and providing energy to said melting chamber at a rate of at least about 10 watts per gram weight of said melting chamber, and a thermostat in direct thermal contact with an opposite side of said heating element.

2. A heating system according to claim 1 wherein said chamber comprises a cylindrical tube of metal forming a cavity.

3. A heating system according to claim 2 wherein said metal is die cast aluminum.

4. A heating system according to claim 2 wherein said melting chamber has walls with a thickness of less than about 0.06 inch.

5. A heating system according to claim 2 wherein said thermostat comprises a metal casing in contact with said heating element.

6. A heating system according to claim 2 wherein said chamber is adapted to receive a stick of hot-melt glue.

7. A heating system according to claim 1 wherein said heating element is a coil of resistance heating wire.

8. A heating system according to claim 2 further comprising an insulating layer between said tube and said heating element.

9. A heating system according to claim 1 further comprising an electrical circuit for providing electrical power to said heating element, said electrical circuit comprising a half-wave rectifier.

10. A heating system for a hand-held glue gun comprising a metal tube having a cavity for receiving solid glue to be melted, an electrically insulating, thermally conducting film mounted on an exterior surface of said tube, a resistance heating wire coil mounted on an exterior surface of said film such that one side of said coil is in thermal contact with said tube and providing energy to said melting chamber at a rate of at least about 10 watts per gram weight of said melting chamber, and a thermostat mounted on an opposite side of said coil to absorb heat directly from said coil.

11. A heating system according to claim 10 further comprising a half-wave rectifier power circuit in series with said thermostat and said coil.

12. A heating system according to claim 10 wherein said tube has a sidewall between said cavity and said exterior with a thickness of less than about 0.06 inch.

13. A heating system according to claim 12 wherein said heating wire coil produces more than about 150 watts.

14. A heating system according to claim 10 wherein said thermostat is mounted in a metal casing, and the metal casing is in thermal contact with said coil.

15. A heating system according to claim 10 wherein said coil provides energy to said metal tube at the rate of about 10–11 watts per gram weight of said metal tube.

* * * * *